United States Patent [19]

Bamburg et al.

[11] 4,037,775

[45] July 26, 1977

[54] BULK REINFORCED LAMINATED CONTAINER

[75] Inventors: Robert A. Bamburg; Farris N. Duncan, both of West Monroe; Roger M. Floyd, Monroe, all of La.

[73] Assignee: Olinkraft, Inc., West Monroe, La.

[21] Appl. No.: 658,967

[22] Filed: Feb. 18, 1976

[51] Int. Cl.[2] ..... B65D 5/72; B65D 5/48; B65D 13/00

[52] U.S. Cl. ..... 229/15; 229/23 R

[58] Field of Search ..... 229/15, 23 R, 17 R; 222/88; 221/302

[56] References Cited

U.S. PATENT DOCUMENTS

| | | | |
|---|---|---|---|
| 2,597,846 | 5/1952 | Reeser | 229/15 |
| 2,686,628 | 8/1954 | Guyer | 229/15X |
| 3,087,666 | 4/1963 | Kitchell | 229/15 |
| 3,185,379 | 5/1965 | Kohlhaas | 229/15 X |
| 3,252,646 | 5/1966 | Rockefeller | 229/15 |
| 3,348,667 | 10/1967 | Beeby | 229/15 X |
| 3,425,615 | 2/1969 | Wood | 229/15 |
| 3,701,466 | 10/1972 | Woodrow et al. | 229/17 R |
| 3,715,072 | 2/1973 | Muskopf | 229/15 |
| 3,744,701 | 7/1973 | Taylor | 229/23 R |
| 3,904,105 | 9/1975 | Booth | 229/23 R |

*Primary Examiner*—Davis T. Moorhead
*Attorney, Agent, or Firm*—O'Brien & Marks

[57] ABSTRACT

A bulk material container has a center I-beam with flanges bonded to opposite side walls together with liners extending, in abutting relationship with the flanges of the beam, around the inside walls of the container.

6 Claims, 9 Drawing Figures

FIG. 1
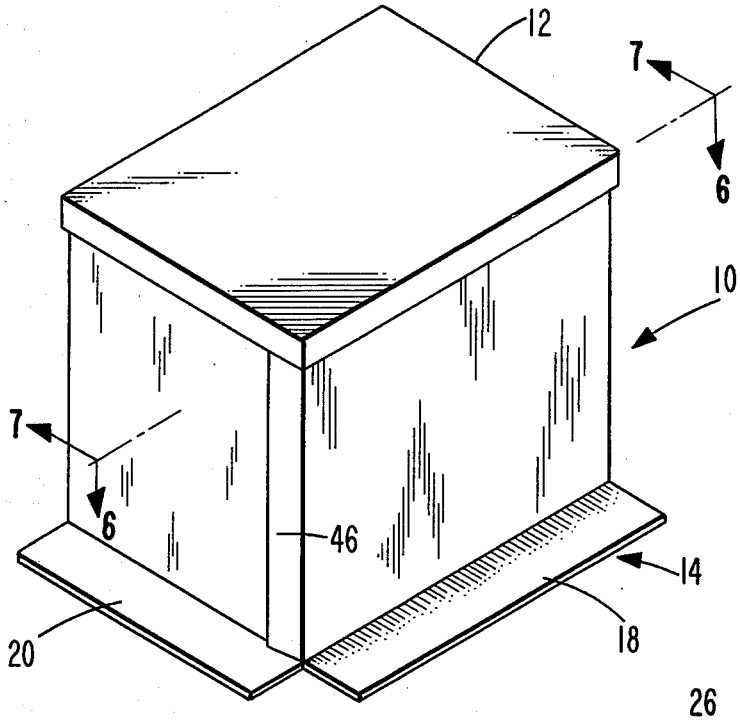
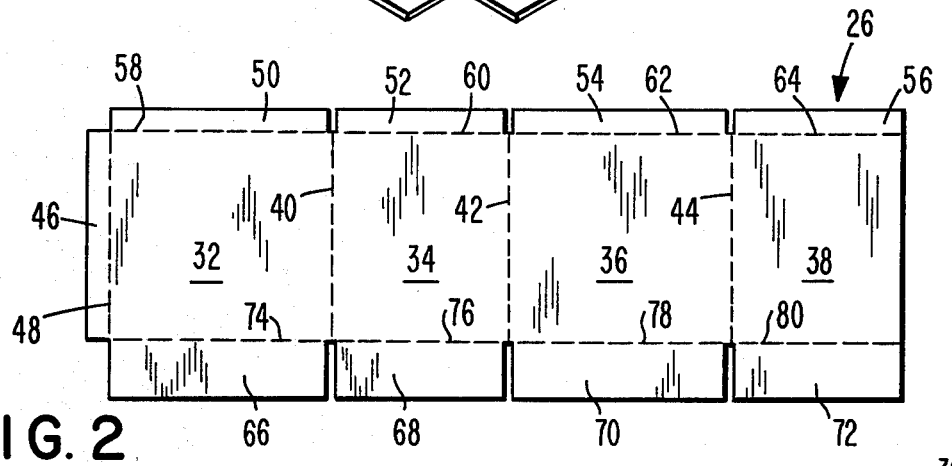
FIG. 2
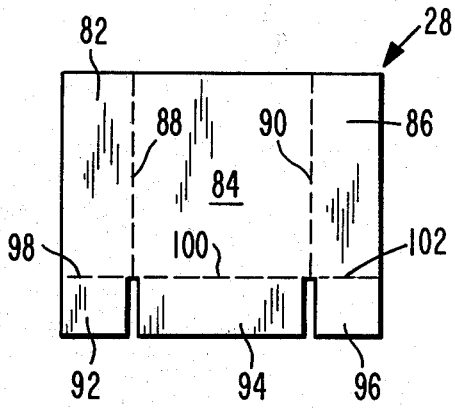
FIG. 3
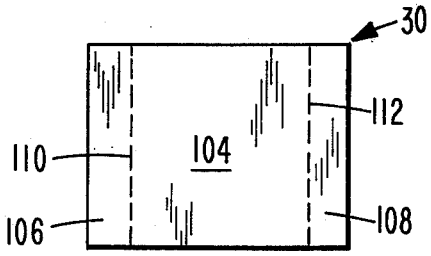
FIG. 4
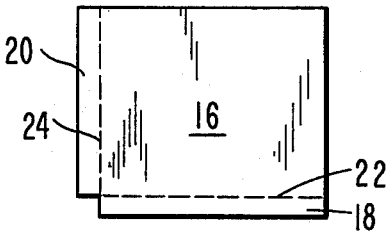
FIG. 5

BULK REINFORCED LAMINATED CONTAINER

BACKGROUND OF THE INVENTION

1. Field of the Invention

This invention relates to containers for storing and shipping bulk materials, such as peanuts or the like.

2. Description of the Prior Art

The prior art includes many containers of corrugated paperboard for storing and shipping bulk materials which have a tendency to bulge the sides of the containers as well as placing limits on the stacking of containers on top of each other. Containers having multi-cell body structures and/or multiple laminated walls such as is shown in U.S. Pat. No. 3,904,105 allow the use of larger bulk material containers which can be stacked and resist bulging. The prior art also, as exemplified in U.S. Pat. Nos. 3,066,842, 3,633,794, and 3,701,466 disclose containers with tubular liners forming multi-cell containers. Other types of prior art containers, such as egg shipping cases, bottle containers, or containers for produce, nails, screws or chains, as exemplified in U.S. Pat. Nos. 2,686,628, 3,456,862, and 3,921,893, have been provided with center dividers having an I-beam or an H-beam structure.

SUMMARY OF THE INVENTION

The invention is summarized in a bulk reinforced laminated container body including an outer shell having four serially joined shell wall panels and a joing flap hinged on the one end of the shell wall panels and secured to the shell wall panel at the other end of the shell wall panels, a center reinforcing partition having two center partition panels joined face-to-face and having two pairs of partition wall panels which are hinged on the side edges of the respective center partition panels, the pairs of partition wall panels extending in opposite directions from the center panels and bonded to inside surfaces of respective side wall panels of the outer shell wall panels, and a pair of liners each having three serially joined liner wall panels wherein the intermediate liner wall panels are bonded to the inside surfaces of the respective end wall panels of the outer shell wall panels and the end liner wall panels are bonded to the inside surfaces of the respective outer shell side wall panels in abutment with the ends of the respective partition wall panels.

An object of the invention is to construct an improved bulk material container which can resist stacking without bulging and can be knocked-down or folded when not in use.

Another object of the invention is to produce a bulk material container which can be offset stacked and still resist bulging.

It is also an object of the invention to design a bulk material container which is easily manufactured and can be readily tailored to meet different uses.

One advantage of the invention is that liners in opposite ends of the outer shell abutting the wall or flange panels of a center partition provide accurate positioning of the center partition.

Other objects, advantages and features of the invention will be apparent from the following description of the preferred embodiment taken in conjunction with the accompanying drawings.

BRIEF DESCRIPTION OF THE DRAWINGS

FIG. 1 is a perspective view of a bulk reinforced laminated container in accordance with the invention.

FIG. 2 is a plan view of a blank for forming an outer shell of the container of FIG. 1.

FIG. 3 is a plan view of one of two identical blanks for forming a center divider in the container of FIG. 1.

FIG. 4 is a plan view of one of two identical blanks for forming end liners in the container of FIG. 1.

FIG. 5 is a plan view of a blank forming a slip sheet for the container of FIG. 1.

DESCRIPTION OF THE PREFERRED EMBODIMENT

Figure 6:
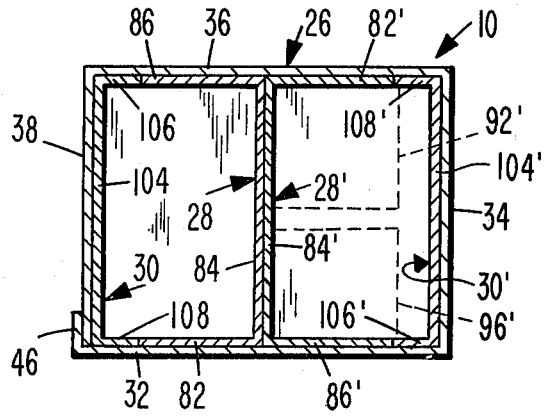
FIG. 6 is a horizontal cross-section taken as indicated at 6—6 of FIG. 1.
Figure 7:
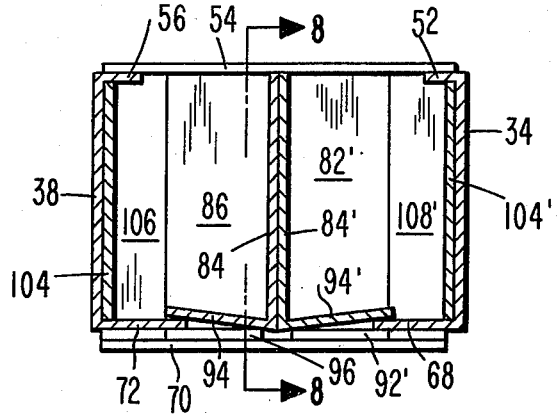
FIG. 7 is an elevation cross-section taken as indicated at 7—7 of FIG. 1.

As illustrated in FIG. 1, the invention is embodied in a bulk reinforced laminated container including a body indicated generally at 10, a top closing means such as a top cap 12, and a bottom support means such as a slip sheet indicated generally at 14. The top cap 12 is conventional top cap utilized in prior art bulk material containers but could be eliminated or replaced by any other top closing lid or arrangement. The slip sheet 14 as shown in FIG. 5 includes a panel 16 corresponding to the bottom of the body 10 of the container with two flaps 18 and 20 hinged at score lines 22 and 24 on respective front and side edges of the panel 16; other conventional bottom supports such as pallets and the like could be used in addition or in place of the slip sheet 16, or a conventional bottom cap could be used.

The container body 10 as shown in FIG. 6 includes an outer shell indicated generally at 26, a center I-beam partition formed from two identidcal members indicated generally at 28 and 28', and two end liners indicated generally at 30 and 30'.

The outer shell 26, as shown in FIG. 2 is formed from a corrugated paperboard blank including four wall panels 32, 34, 36 and 38 which are serially joined at a score line 40 between panels 32 and 34, at a sorce line 42 between panels 34 and 36, and at a score line 44 between panels 36 and 38. A joint flap 46 is hinged at score line 48 on the panel 32 at one end of the series panels 32, 34, 36 and 38, and as shown in FIG. 6, is secured to the outside of the panel 38 at the other end of the series panels to form an enclosed wall. Top flaps 50, 52, 54 and 56 are hinged at score lines 58, 60, 62 and 64 on the top edges of respective wall panels 32, 34, 36 and 38 while bottom flaps 66, 68, 70 and 72 are hinged at score lines 74, 76, 78 and 80 on the bottom edges of the respective wall panels 32, 34, 36 and 38.

The member 28, as shown in FIG. 3, is a corrugated paperboard blank having three series panels 82, 84 and 86 wherein the flange or wall panels 82 and 86 are hinged at score lines 88 and 90 on the respective side edges of the center panel 84. Bottom flaps 92, 94 and 96 are hinged at score lines 98, 100 and 102 on the bottom edges of the resective panels 82, 84 and 86.

The end liner 30, as shown in FIG. 4, is formed from a corrugated paperboard blank which includes an end panel 104 having short side wall panels 106 and 108 hinged at score lines 110 and 112 in the respective opposite side edges of the end panel 104.

In FIGS, 6, 7 and 9, the member 28' and liner 30' have parts indentified by the same numbers identifying parts of the member 28 and liner 30 with the addition of a prime (') symbol; such parts identified by the same numbers are substantially identical. The center panels 84 and 84' are bonded together in face-to-face relationship while the pair of flange panels 82 and 86 extend in a first direction from the panel 84 and are bonded to the inside surfaces of the side wall panels 32 and 36 of the shell 26, and the pair of flange panels 82' and 86' of the member 28' extend in a direction opposite to the flange panels 82 and 86 and are similarly bonded to the inside surfaces of the panels 36 and 32. The end panels 104 and 104' are bonded to the inside surfaces of the respective end wall panels 38 and 34 of the outer shell 26 while the short side wall panels 106, 108, 106' and 108' are bonded to the inside surfaces of the wall panels 32 and 36. The panels 106, 108, 106' and 108' have sizes designed to bring them into abutment with the respective flange panels 86, 82, 86' and 82' of the members 28 and 28'.

Figure 8:
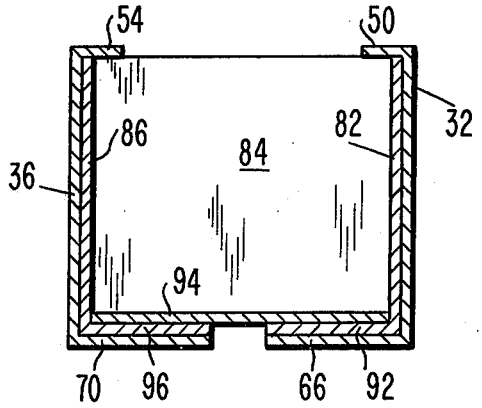
FIG. 8 is a side elevation cross-section taken as indicated at 8—8 of FIG. 1.
Figure 9:
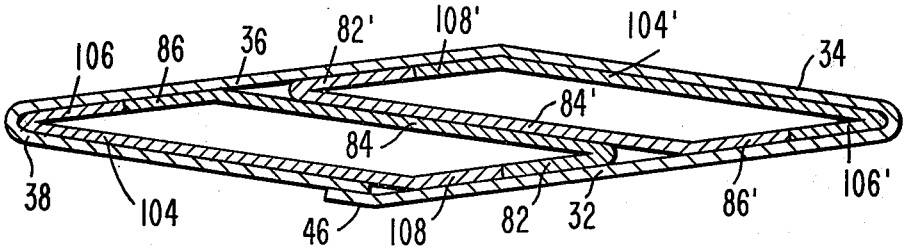
FIG. 9 is a cross-section along the same plane as FIG. 6 but illustrating a knocked-down or folded condition of the container body.

The top flanges 50, 52, 54 and 56, see also FIG. 8, are folded to a horizontal position while the bottom flaps 66, 68, 70, 72, 92, 94, 96, 92', 94' and 96' are also folded inward to a horizontal position to form a bottom and to reinforce the side walls of the container.

By utilizing the I-beam partition formed by the members 28 and 28' in conjunction with the end liners 30 and 30' a balanced two-ply structure is formed. The abutting ends of the liners 30 and 30' accurately position the partition or the center panels 84 and 84' so that accurate balance between the ends of the container is maintained to insure stacking strength when subject to offset stacking; unbalanced containers are subject to collapse or wall bowing due to weakness of certain parts or walls due to the unbalance. Since the structure of the container is substantially two-ply throughout, the strength of the container is optimized relative to the amount of corrugated paperboard used in forming the container, i.e., two-ply strength is maintained throughout, and unnecessary three-ply portions are eliminated.

The members 28 and 28' being secured together and bonded to the opposite side walls substantially increase the strength of the outer walls as well as providing a center support for the stacked containers.

The use of separate members 28 and 28' and liners 30 and 30' produces a container which is easy to assemble as well as allowing for selection of relative strengths of paperboard material to provide the most economical use of material, i.e., the end liners 30 and 30' and the members 28 and 28' can be selected to have the same or different strengths to meet the requirements of the container with the use of a minimum amount of paper raw materials.

It is also noted that the optional employment of four bottom flaps 66, 68, 70 and 72 on the outer shell and six flaps 92, 94, 96, 92', 94' 96' and produces substantial reinforcement of the bottom portions of the walls of the container where the greatest amount of force from the bulk material is present and particularly adjacent the center partition where the center of the mass of material in the container is located.

Since many variations, modifications and changes in detail may be made to the described embodiment, it is intended that all matter in the foregoing description and shown in the accompanying drawings be interpreted as illustrative and not in a limiting sense.

What is claimed is:

1. A bulk reinforced laminated container body comprising an outer shell having four serially joined shell wall panels and a joint flap hinged on one end of the shell wall panels and secured to the shell wall panel at the other end of the shell wall panels, a center reinforcing partition having two center partition panels joined face-to-face and having two pairs of partition wall panels which are hinged on the side edges of the respective center partition panels, said pairs of partition wall panels extending in opposite directions from the center panels and bonded to inside surfaces of respective side wall panels of the outer shell wall panels and a pair of liners each having three serially joined liner wall panels wherein the intermediate liner wall panels are bonded to the inside surfaces of respective end wall panels of the outer shell wall panels and the end liner wall panels are bonded to the inside surfaces of the respective outer shell side wall panels in abutment with the ends of respective partition wall panels.

2. A bulk reinforced laminated container body as claimed in claim 1 including four bottom flaps integrally hinged on the bottom edges of the respective shell wall panels, six bottom flaps integrally hinged upon the bottom edges of the respective two center partition panels and two pairs of partition wall panels, and four top flaps integrally hinged on the top edges of the respective outer shell wall panels.

3. A bulk reinforced laminated container body as claimed in claim 1 wherein said pairs of partition wall panels have identical sizes, and said end liner wall panels have identical sizes.

4. A bulk reinforced laminated container body as claimed in claim 1 wherein said outer shell, said center reinforcing partition and said pair of liners are formed from corrugated paperboard.

5. A bulk reinforced laminated container including the container body as claimed in claim 1 and further including a top cap.

6. A bulk reinforced laminated container including the container body as claimed in claim 1 and further including a bottom slip sheet.

* * * * *

UNITED STATES PATENT OFFICE

CERTIFICATE OF CORRECTION

Patent No. 4,037,775 Dated July 26, 1977

Inventor(s) Robert A. Bamburg, Farris N. Duncan, Roger M. Floyd

It is certified that error appears in the above-identified patent and that said Letters Patent are hereby corrected as shown below:

Column 1, line 15, following Pat. No. 3,904,105, insert a -- , --.
Column 1, line 31, delete "joing" and insert in place thereof -- joint --.
Column 2, line 29, following the word is, insert the word -- a -- .
Column 2, line 42, delete the word "identidcal" and insert in place thereof -- identical --.
Column 2, line 48, delete the word "sorce" and insert in place thereof -- score --.
Column 2, line 66, delete "resective" and insert in place thereof -- respective --.
Column 3, line 26, following the word folded insert the word -- inward --.
Column 3, line 59, following the word six insert the word -- bottom --.
Column 4, line 1, after 94' insert the word -- and --.
Column 4, line 1, after 96' delete the word "and".
Column 4, line 26, following the word panels insert a -- , --.

Signed and Sealed this

Eighth Day of November 1977

[SEAL]

Attest:

RUTH C. MASON
Attesting Officer

LUTRELLE F. PARKER
Acting Commissioner of Patents and Trademarks